US008375762B2

(12) United States Patent
Funatsuki et al.

(10) Patent No.: US 8,375,762 B2
(45) Date of Patent: Feb. 19, 2013

(54) STRIPPER DEVICE FOR CAN DRAWING AND IRONING APPARATUS

(75) Inventors: Hiromitsu Funatsuki, Yokohama (JP); Hidekazu Tomaru, Yokohama (JP); Susumu Sakamoto, Hiroshima (JP); Toshiki Okuda, Hiroshima (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 666 days.

(21) Appl. No.: 12/597,142

(22) PCT Filed: Apr. 11, 2008

(86) PCT No.: PCT/JP2008/057133

§ 371 (c)(1), (2), (4) Date: Oct. 22, 2009

(87) PCT Pub. No.: WO2008/133031

PCT Pub. Date: Nov. 6, 2008

(65) Prior Publication Data

US 2010/0126243 A1 May 27, 2010

(30) Foreign Application Priority Data

Apr. 25, 2007 (JP) ..... 2007-115081

(51) Int. Cl.
*B21D 45/00* (2006.01)

(52) U.S. Cl. ..... 72/344; 72/427

(58) Field of Classification Search ..... 72/344–347, 72/427; 83/136–141; 100/112, 174
See application file for complete search history.

(56) References Cited

U.S. PATENT DOCUMENTS 3,295,351 A * 1/1967 Jacobs ..... 72/344
3,886,781 A * 6/1975 Paramonoff et al. ..... 72/344
3,990,289 A * 11/1976 Widmann et al. ..... 72/345
4,121,447 A * 10/1978 Sniady ..... 72/344

(Continued)

FOREIGN PATENT DOCUMENTS

GB 2181685 * 4/1987
JP 2-165821 A 6/1990

(Continued)

OTHER PUBLICATIONS

International Preliminary Report on Patentability for Application No. PCT/JP2008/057133 mailed Nov. 19, 2009.

(Continued)

*Primary Examiner* — Dana Ross
*Assistant Examiner* — Leonel Vasquez
(74) *Attorney, Agent, or Firm* — Cheng Law Group, PLLC

(57) ABSTRACT

A stripper device for can drawing and ironing apparatus can remove a drawn and ironed can material from a punch without causing buckling (curl and wrinkle) on the material. Each finger (2) is split into three small fingers (21), and an axial end of each small finger (21) is engaged with the lower part of a rocking arm (3) with an elastic member (24) in between. A head portion (33) of each rocking arm (3) is engaged with a cam portion (42) of a cam ring (4) to allow the finger (2) to be driven independently each other. Each rocking arm (3) is biased by an arm spring (32) in the direction of opening the small finger (21), while the small finger (21) is biased by a finger spring (22) in the direction of its closure.

7 Claims, 8 Drawing Sheets

U.S. PATENT DOCUMENTS

| | | | | |
|---|---|---|---|---|
| 4,606,215 | A * | 8/1986 | McMillin | 72/344 |
| 7,243,520 | B2 * | 7/2007 | Woulds | 72/344 |

FOREIGN PATENT DOCUMENTS

| | | | |
|---|---|---|---|
| JP | 4-345748 | A | 12/1992 |
| JP | 6-59509 | B2 | 8/1994 |
| JP | 6-269865 | A | 9/1994 |
| JP | 2003-103312 | A | 4/2003 |
| JP | 2003-145226 | A | 5/2003 |
| JP | 3858651 | * | 12/2006 |
| JP | 3858651 | B2 | 12/2006 |
| WO | WO 0045975 | * | 8/2000 |

OTHER PUBLICATIONS

International Search Report for the Application No. PCT/JP2008/057133 mailed Jul. 15, 2008.

* cited by examiner

Fig. 7
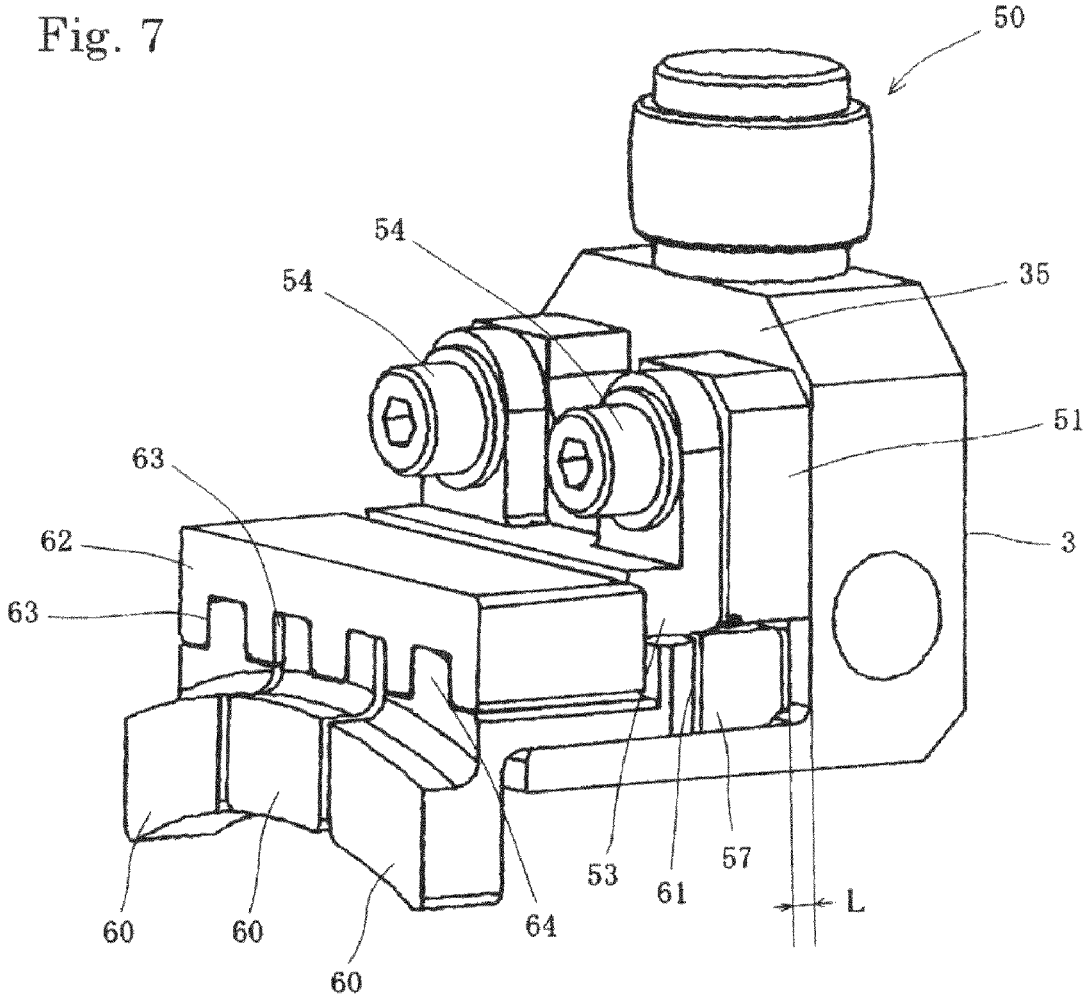
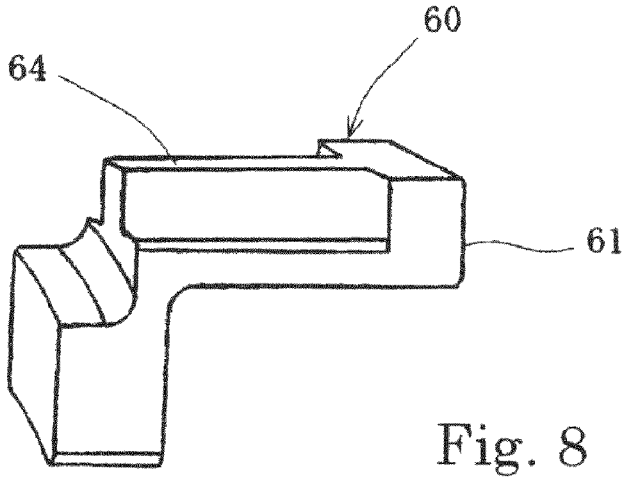
Fig. 8

STRIPPER DEVICE FOR CAN DRAWING AND IRONING APPARATUS

TECHNICAL FIELD

The present invention relates to a stripper device for a can drawing and ironing apparatus, and more particularly to a stripper device for a can drawing and ironing apparatus that is able to remove a can material that is stretched over a punch after drawing and ironing from the punch with good stability and high speed, without damaging the can material.

BACKGROUND ART

When a two-piece can in which a can body and a can bottom are integrated, for example, a drawn-ironed can or stretched-drawn-ironed can (in the present description, when the two types of cans are not distinguished from each other, both will be referred to as drawn-ironed can) is molded, the so-called ironing process is performed in which the desired shape is molded, while inserting the can material into a narrow gap between a punch and a die. In such ironing processing, the can material is literally covered on the punch and the can material is strongly pressed against and ironed by a die called an ironing die. As a result, the can material is stretched over the punch and it is difficult to separate the punch and the can material (poor stripping ability). Therefore, a variety of stripper devices that overcome such poor removability of the can material have been suggested. These devices are composed of a plurality of fingers that come into contact with the opening end portion of the can material and the outer circumferential surface of the punch. These fingers have hooks at the distant ends thereof and are tightly arranged annularly along the end portion of a sleeve, while being biased in the direction of closing the hooks located at the distant ends of the fingers by an annular spring (elastic body). The can material that has been stretched over the punch upon completion of the ironing process is firstly passed through the sleeve of the stripper device. In this case, the can material is directed toward a doming process, which is a very last processing step, while pushing out and spreading the fingers. Because the fingers are thus percussively spread by the can material, the can material is dented, and when the fingers are then percussively closed causing a jumping phenomenon, the can material is further dented. Alternatively, the can material is scratched and dented by finger hooks. In a punch return process, the edge portion of the can body (can material) and the distal end engagement portion of the fingers are engaged and the can is removed from the punch. A force that closes the fingers depends on the biasing force of the annular elastic body.

In order to prevent the can body from being dented by the fingers, a stripper device has been suggested in which opening and closing of the fingers biased by an annular spring in the closing direction is controlled by an outer cam ring that cannot move in the axial direction, but is capable of moving in the circumferential direction, and an inner cam ring that is capable of moving in the axial direction (see, for example, Patent Document 1). In this stripper device, in the forward stroke of the punch, where the outer cam ring is forcibly rotated by a lever, the inner cam moves axially to an upper dead center, thereby opening the fingers and allowing the can body engaged with the punch to pass, and in the return stroke of the punch, the outer cam ring rotates in the opposite direction and returns to the original state, whereby the fingers are closed by the annular spring, the distal end of the can is engaged with the fingers, and the can body is separated from the punch. With such a configuration, the vicinity of the distal end of the punch is prevented from hitting the fingers and the can body is not dented. However, in some cases the fingers interfere with each other and all the fingers are not closed completely. The resultant problem is that the can may be cracked in the axial direction in the vicinity of those fingers that have not been closed.

In order to resolve this problem, a stripper device has been suggested (see, for example, Patent Document 2) in which the length of the engagement portions at the distal end of each finger is increased to ensure that the fingers do not interfere, the fingers are installed independently and annularly in six segments along a center hole, each finger is provided with a rocking fulcrum and biased by a spring in the closing direction, and a cam follower is installed in the head portion of each finger. In addition, an outer cam ring is rotatably supported and the outer cam ring is rotated by a lever so that when the cam follower mates with a concave portion (recess) of the outer cam ring, the finger swings (rotates) in the direction of closing by the action of the spring, whereas when the cam follower abuts against a flat portion (not receding portion) of the outer cam ring, the finger swings in the direction of opening against the spring force. As a result, each finger is forcibly and independently opened and closed.

Patent Document 1: Japanese Examined Patent Publication No. H6-59509.

Patent Document 2: Japanese Patent No. 3858651.

DISCLOSURE OF THE INVENTION

Problem to be Solved by the Invention

In the stripper device described in Patent Document 2, the springs involved in driving the fingers are provided independently. Therefore, the fingers are prevented from interfering with each other, the can body is not dented, and the stripping ability is stable.

However, large buckling occurs in the opening end portion of the can body (folding or wrinkling of the edge portion of the can body). Therefore, this buckling cannot be completely removed in the subsequent trimming, a rejection ratio of products is high, and high-speed stable production cannot be performed. This is apparently because the stripper fingers in the six segments are too large and the structure does not ensure cushioning of the fingers in the axial direction, thereby making it impossible to trace fine convexities and concavities of the opening portion of the can body.

Further, with the cans that are obtained by molding by a stretch-draw-ironing method a metal sheet laminated on the inner and outer surface with synthetic resin films, at a point of time in which the can is pulled out off the punch after molding, the can sticks to the punch and sometimes cannot be pulled out (end portion buckling, poor stripping). This is because the inner and outer circumferential surfaces of the can are laminated with a PET film and also because dry molding is performed that uses no lubricating oil during molding, which results in cooling capacity lower than that during wet welding and a high temperature of the punch. When the stripper device described in Patent Document 1 is used for such laminated cans, the can becomes strongly attached to the punch, buckling occurs, the can is cracked, and the PET film on the outer surface of the can is damaged, resultantly failing to qualify as products. In addition, the stripper fingers are also damaged. For this reason, in the stripper device described in Patent Document 2, the six stripper fingers are forcibly opened and close, an individual spring is provided for each finger, the fingers and can edge are reliably engaged, and the can is prevented from denting and cracking. However, can buckling (curling or wrinkling) is still large and cannot be completely removed by trimming, thereby making it impossible to reduce the product rejection ratio.

Accordingly, the present invention was created with consideration for the above-described problems inherent to the related prior art, and it is an object of the present invention to provide a stripper device for a can drawing and ironing apparatus that can remove a can material that has been stretched over the punch after drawing and ironing, with good stability and high rate, without damaging the can material.

Means for Solving the Problem

In order to attain the above-described object, the stripper device for a can drawing and ironing apparatus as set forth in the first aspect of the present invention includes: a plurality of finger sections that abut against an opening end portion of a can material that is stretched over a punch and detach the can material from the punch; and a drive unit that opens or closes each finger section, wherein the finger section is formed of a plurality of small fingers and each small finger is configured to be capable of elastically moving in an axial direction of the punch.

With the above-described stripper device for a can drawing and ironing apparatus, because the finger section is composed of a plurality of small fingers and each small finger is capable of moving in the axial direction, the small fingers engage according to the concave-convex shape of the opening end portion of the can material when the can material is pulled out. As a result, when the punch is pulled out, the compressive load received by the can material from the fingers is advantageously dispersed over the entire circumference of the opening end portion and load concentration is prevented. Furthermore, because the small fingers are capable of moving elastically in the axial direction of the punch, by moving the small fingers backward, it is possible to reduce advantageously the compressive load or absorb advantageously the impact force acting during rapid pull-out. As a result, the can material is prevented from buckling.

In the stripper device for a can drawing and ironing apparatus according to the second aspect of the present invention, the drive unit is formed of a plurality of rocking arms each having a rocking fulcrum corresponding to each finger section and a rotatable cam ring, that has cam portions that engage with the rocking arms. With such a stripper device, the above-described configuration eliminates interference between adjacent finger sections, thereby making it possible to conduct reliably the opening and closing operation of the finger sections.

In the stripper device for a can drawing and ironing apparatus according to the third aspect of the present invention, the rocking arm is biased in advance by a first elastic member in a direction of opening the small fingers, and the small fingers are biased in advance by a second elastic member in a closing direction at a lower portion of the rocking arm. With such a stripper device, the above-described configuration makes it possible to conduct reliably the opening and closing operation of the finger sections.

In the stripper device for a can drawing and ironing apparatus according to the fourth aspect of the present invention, an upper portion of the rocking arm is engaged with the cam ring that may rotate relative to the axial direction of the punch, and the upper portion is configured to open the small fingers when mating with a concave portion of the cam ring. With such a stripper device, the above-described configuration makes it possible to conduct reliably the opening and closing operation of the finger sections.

In the stripper device for a can drawing and ironing apparatus according to the fifth aspect of the present invention, the plurality of small fingers constituting each finger section are biased in the closing direction by the second elastic member via a pushing member, and an end portion of each of the small fingers in the axial direction is locked to the lower portion of the rocking arm, with a third elastic member. With such a stripper device for a can drawing and ironing apparatus, the above-described configuration makes it possible to conduct reliably the opening and closing operation of the finger sections. Furthermore, the small fingers engage according to a concave-convex shape of the opening end portion of the can material.

In the stripper device for a can drawing and ironing apparatus according to the sixth aspect of the present invention, the third elastic member is formed of an elastic body in the form of a rectangular parallelepiped that is provided independently for each finger section, the third elastic member being attached to the rocking arm. With such a stripper device, because of the above-described configuration of the third elastic member, each finger section can be displaced independently, the adjacent fingers create no strains in the elastic body (by contrast with a configuration with a continuous O-ring), the service life of the elastic body is increased, and the opening and closing operation of the small fingers can be conducted more reliably.

In the stripper device for a can drawing and ironing apparatus according to the seventh aspect of the present invention, a small finger abutment protrusion is formed at the elastic body in the form of a rectangular parallelepiped mainly, the small finger abutment protrusion being formed correspondingly to each end portion of the small fingers. In the stripper device for a can drawing and ironing apparatus according to the eighth aspect of the present invention, a metal plate that has a surface area at least covering the small finger abutment surface is provided at a distal end portion of the small finger abutment protrusion.

With such a stripper device, because of the above-described configuration, the distal end portion of the small finger abuts against the small finger abutment protrusion of the elastic body, with a protective plate. Therefore, the compressive force or shear three created by the small fingers is received by the protective plate and only a unidirectional compressive force acts upon the elastic body. Wear and damage caused by rubbing or the like may he prevented even more reliably, endurance a the elastic body that is the third elastic member is increased, and the device may be operated for a long time.

In the stripper device for a can drawing and ironing apparatus according to the ninth aspect of the present invention, an axial guide is provided between an upper surface of each small finger and a lower surface of the pushing portion so that each of the small fingers can move independently along the axial direction. With such a stripper device, because of the above-described configuration, each small finger moves parallel to the axial center along a guiding groove, the small fingers operate reliably without interfering with each other, and no eccentric load is applied to the elastic body.

Effects of the Invention

With the stripper device for a can drawing and ironing apparatus in accordance with the present invention, the finger section that grasps the punch over which the can material has been stretched is composed of a plurality of small fingers and each small finger is configured to be capable of elastically moving in the axial direction of the punch. Therefore, each small finger is capable of engaging according to the concave-convex shape of the opening end portion of the can material. As a result, when the can material is pulled out off the punch, the load received by the can material from the small fingers is advantageously dispersed and reduced. As a result, the can material that has been stretched over the punch may be pulled out with goods stability, without buckling such as wrinkles and rupture such as curls.

Further, because each finger section is driven by the cam ring via individual separate rocking arm having a rocking fulcrum, the rocking arm is biased in advance by a first elastic member in the direction of opening the small fingers, and the small fingers are biased in advance by a second elastic member via a pushing member in the closing direction, when the upper portion of the rocking arm mates with the concave portion of the cam ring, the rocking arm rotates about the rocking fulcrum and raises the small fingers under the effect of the first elastic member, and the finger section is opened. When the upper portion of the rocking arm mates with a flat portion (not receding portion) of the cam ring, the rocking arm rotates in the opposite direction under the effect of the cam and sets the small fingers into the initial state and the finger section is closed under the effect of the second elastic member. As a result, the opening-closing operation of the finger section may be performed rapidly and reliably. Furthermore, because the small fingers are locked to the lower portion of the rocking arm via a third elastic member, the small fingers advantageously match the concave-convex shape of the opening end portion of the can material. Therefore, the fast and reliable opening-closing operation of the finger sections is combined with good matching of the small fingers with the opening end portion of the can material and the can material that has been stretched over the punch after drawing and ironing may be pulled out rapidly and with good stability.

Further, by disposing an elastic body in the form of a rectangular parallelepiped as an independent third elastic member at each finger section, it is possible to ensure individual displacement for each finger, the adjacent fingers are prevented from applying strains to the elastic bodies, the service life of the elastic bodies is extended, and the opening-closing operation of the small fingers may be performed reliably. In addition, by providing a metallic protective plate on the receiving surface of each finger of the elastic body, it is possible to absorb the shear force by the protective plate and greatly improve the service life of the elastic bodies. Furthermore, because the displacement of small fingers in the axial direction is controlled by a guide, any unnecessary movement such as torsion of the fingers with respect to the axial direction is prevented.

BRIEF DESCRIPTION OF THE DRAWINGS

FIG. 7 is a perspective view of a finger section assembly.

FIG. 8 is a perspective view of the small finger.

EXPLANATION OF REFERENCE NUMERALS

Figure 1:
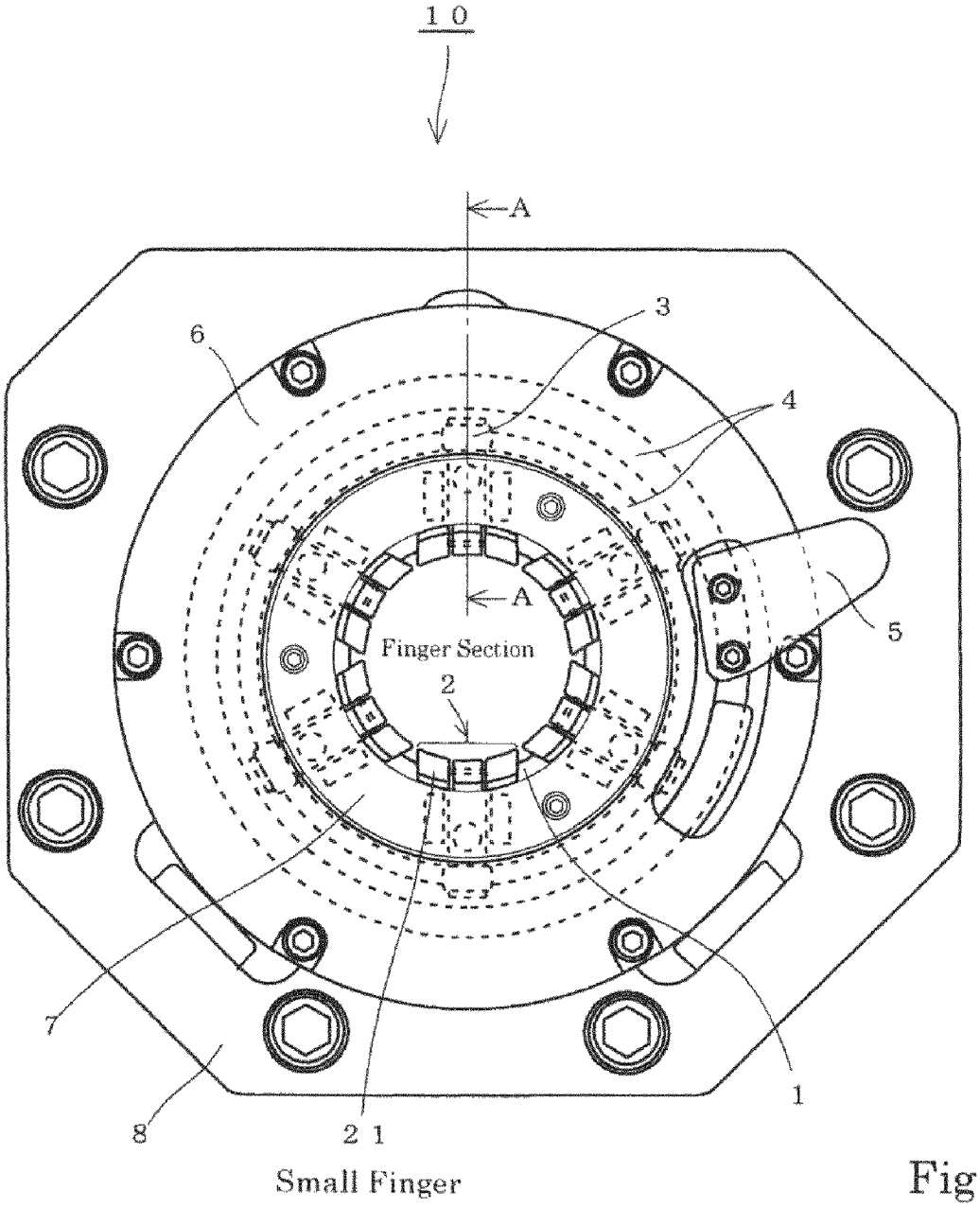
FIG. 1 is an explanatory drawing illustrating a stripper device for a can drawing and ironing apparatus in accordance with the present invention.

1 sleeve
2 finger section
3 rocking arm
4 cam ring
5 cam lever
6 spring holder
7 pushing plate
8 body
50 finger section assembly
51 elastic body
55 abutment protrusion
57 protective plate
60 small finger
62 guide
10, 70 stripper device for a can drawing and ironing apparatus

BEST MODE FOR CARRYING OUT THE INVENTION

The present invention will be described below in greater detail with reference to embodiments thereof illustrated by the appended drawings.

FIG. 1 is an explanatory drawing illustrating a stripper device 10 for a can drawing and ironing apparatus.

The stripper device 10 for a can drawing and ironing apparatus is provided with a sleeve 1 that passes inside thereof a punch over which a can material has been stretched, finger sections 2 that come into contact with an opening end portion of the can material, while grasping the punch over which the can material has been stretched, rocking arms 3 that open and close the finger sections 2, a cam ring 4 that drives the rocking arms 3, a cam lever 5 that rotates the cam ring 4, a spring holder 6 that accommodates a first elastic member and a second elastic member that apply a biasing load to the finger sections 2 and rocking arms 3, and a pushing plate 7 and body 8 that support the above-described components.

The finger sections 2 are disposed annularly with a 60° spacing (in the present embodiment, 6 finger sections) along the end portion of the sleeve 1. In the finger section 2, the finger section that has conventionally been constituted by a single member is divided, for example, into three segments (small fingers 21), and each small finger 21 is configured to be capable of moving elastically in the axial direction. The possibility of moving elastically means that there is a possibility of automatically returning into the original position after the movement has been completed.

With such a configuration in which the finger section 2 is divided into three small fingers 21 and each finger 21 can move elastically in the axial direction, each small finger 21 can advantageously engage according to the concave-convex shape of the opening end portion of the can material; the possibility of such an engagement will be described below in greater detail with reference to drawings in FIG. 4. As a result, when the punch is caused to move in a state in which the opening end portion of the can material abuts against the finger sections 2, each small finger 21 can advantageously engage according to the concave-convex shape of the opening end portion of the can material, thereby making it possible to disperse advantageously the load received by the can material from the finger sections 2 and also advantageously reduce or absorb the dispersed load because of elastic rearward movement of the small fingers 21.

The rocking arms 3 transmit the action of the cam ring 4 to the finger sections 2 and opens or closes the finger sections 2. Further, the finger sections 2 are biased in the opening direction by the first elastic member. This will be described below in greater detail with reference to FIG. 2 and FIG. 3.

The cam ring 4 can rotate about the central axis and has the recesses (concave portions) regularly formed in the surface facing the head portion of the rocking arms 3; the recesses serve for mating with the head portion. When the head portion of the rocking arm 3 mates with the recess, the rocking arm 3 rotates (swings) thereby raising the finger section 2. When one rocking arm 3 mates with the recess of the cam ring 4, the other all rocking arm 3 synchronously mates with a respective recess.

The cam lever 5 rotates the cam ring 4. The drive of the cam lever 5 is conducted manually or automatically with an actuator. The spring holder 6 accommodates the first elastic member that biases the rocking arm 3 in a predetermined direction and the second elastic member that biases the finger sections 2 in a predetermined direction. The pushing plate 7 prevents the finger sections 2 from falling out. The body 8 has a groove that receives the cam ring 4, and a ball bearing that reduces friction to enable the cam ring 4 to rotate smoothly is incorporated in the groove.

Figure 2:
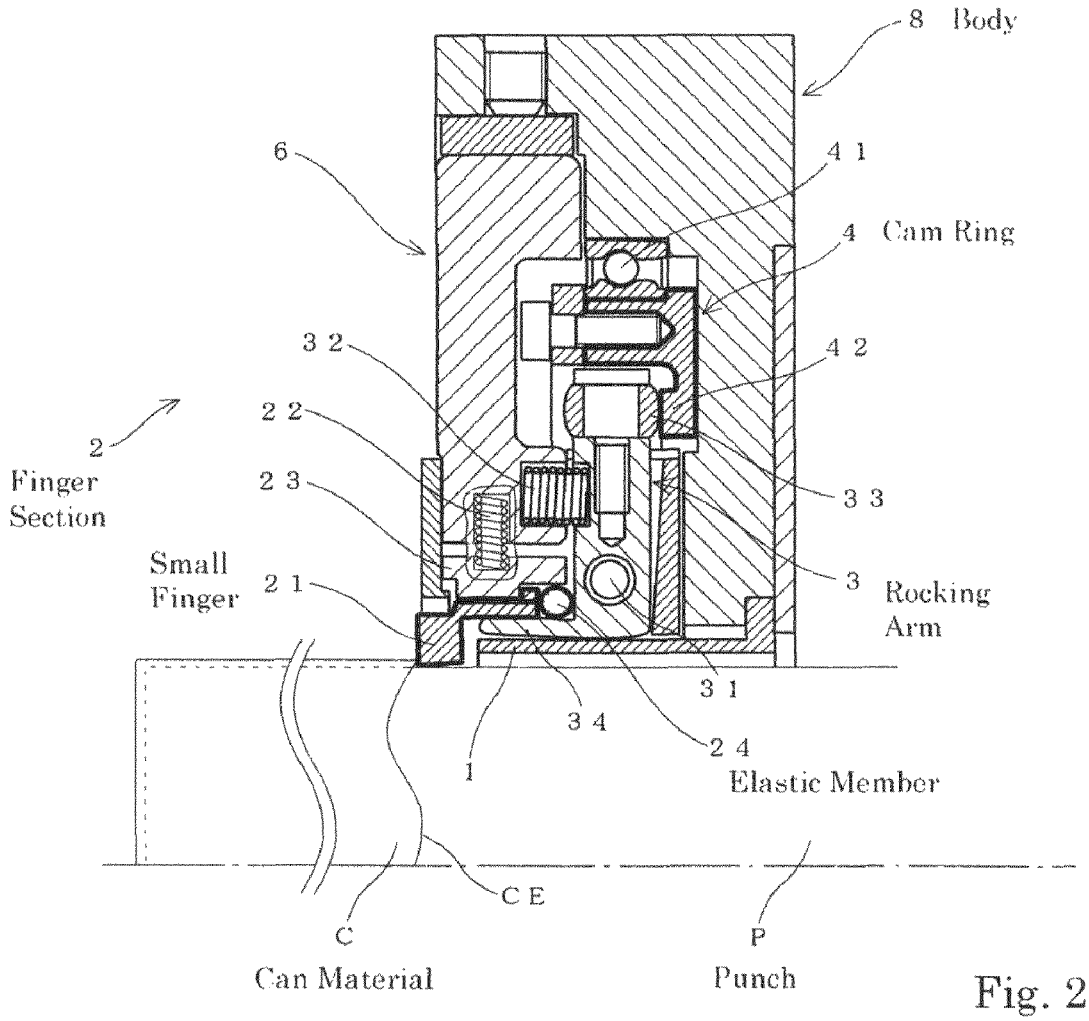
FIG. 2 is an A-A cross-sectional view of the configuration shown in FIG. 1.

FIG. 2 is an A-A sectional view of the configuration shown in FIG. 1. For convenience of explanation, the can material C and punch P are shown in the figure.

The finger section 2 is composed of small fingers 21 (in the present embodiment, three small fingers are disposed in each finger section 2) that come into contact with the can material C or punch P, finger springs 22 (second elastic members, two in the present embodiment) that bias the small fingers 21 in the closing direction, a finger plate 23 (pushing member) that transmits the load of finger springs 22 to the three small fingers 21, and an elastic member 24 (third elastic member) that returns the displaced small fingers 21 to the original position. Thus, the small fingers 21 can move elastically not only in the radial direction, but also in the axial direction. Therefore, when the punch P is moved in a state in which the small fingers 21 are locked with the opening end portion CE of the can material C, in other words, when can material C is pulled out off the punch P, the load received by the can material C from the small fingers 21 is advantageously reduced or advantageously absorbed. As a consequence, no buckling such as curls or wrinkles appear in the can material C when the can material C is pulled out off the punch P.

A total of three grooves (not shown in the figure) are formed in the surface of the finger plate 23 that faces the small fingers 21, the small fingers 21 are mated with the grooves, and the small fingers 21 are disposed so as to avoid interference therebetween.

The rocking arm 3 can rotate about a rocking fulcrum 31. The rocking arm is biased by an arm spring 32 (first elastic member) in the direction of opening the small fingers 21, and a rotation force is applied thereto at all times in the direction of rotating clockwise (CW) about the rocking fulcrum 31. A head portion 33 located in the upper part of the rocking arm 3 engages with a cam portion 42 of the cam ring 4, and a pickup portion 34 located in the lower part of the rocking arm engages with the small fingers 21. Therefore, where the rocking arm 3 rotates (swings) in the CW direction, the pickup portion 34 raises the small fingers 21 and the finger section 2 is opened.

Figure 3:
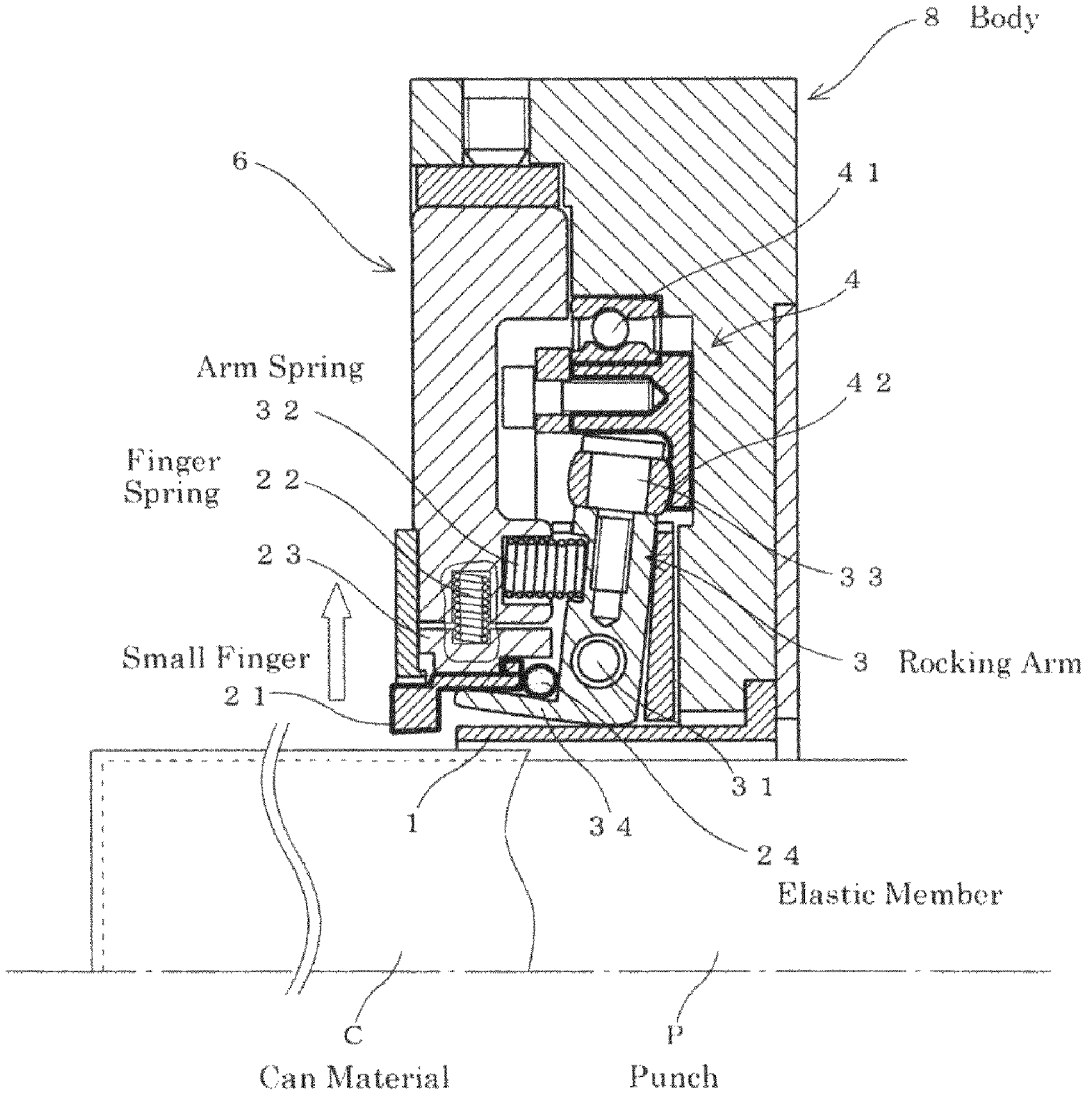
FIG. 3 is an explanatory drawing illustrating the operation of a rocking arm.

The cam ring 4 is rotatably supported at the body 8 via a cam bearing 41 and has formed therein cam portions 42 (recesses) that mate with the head portions 33 of the rocking arms 3. The cam portions are arranged equidistantly in the circumferential direction. Further, as shown in FIG. 3, when the head portion 33 mates with the recess of the cam portion 42, the head portion rotates in the CW direction with respect to the rocking fulcrum 31, the small fingers 21 are raised, and the finger section 2 is opened.

Figure 4:
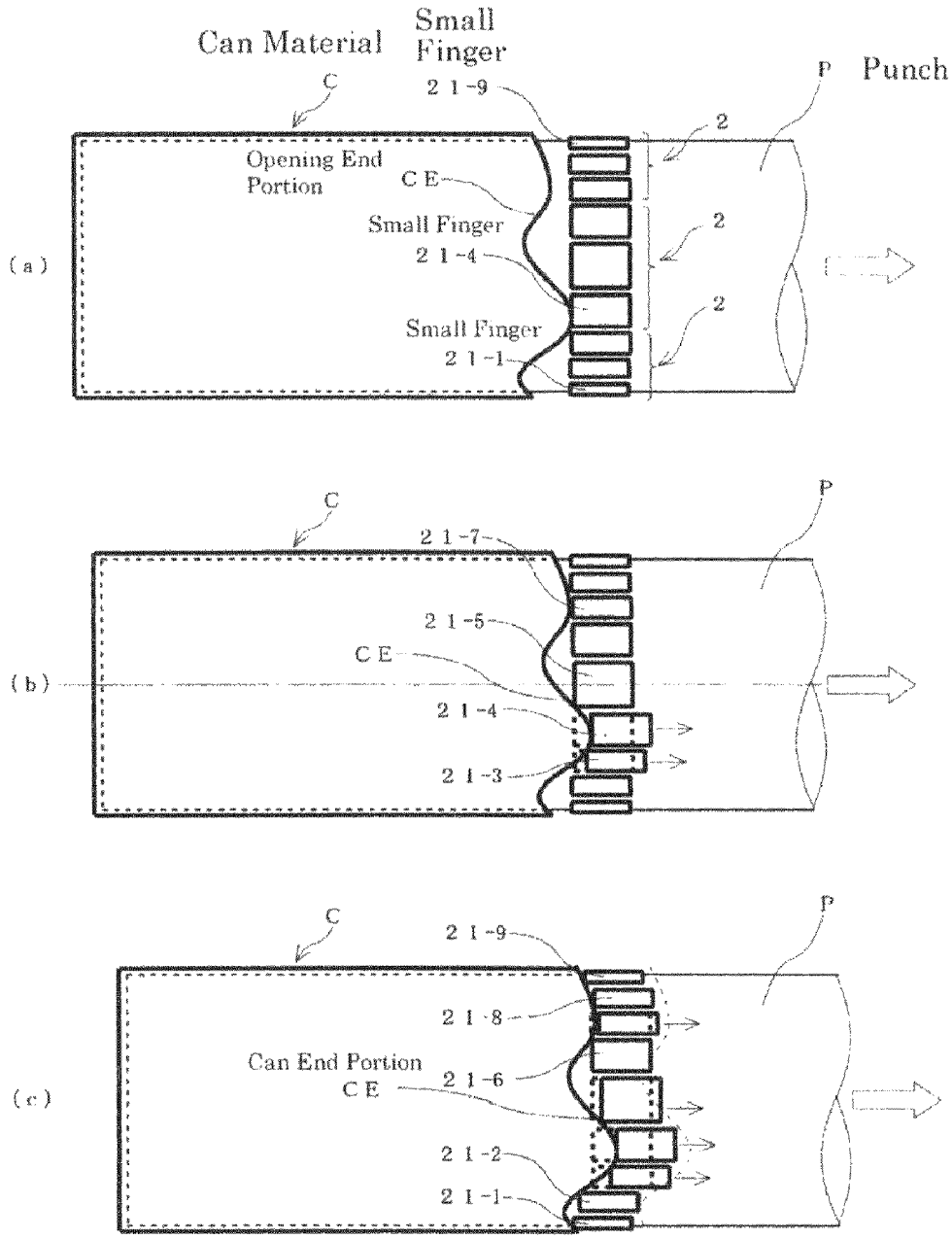
FIG. 4 shows explanatory drawings illustrating the operation of a small finger.

FIG. 4 shows explanatory drawings illustrating the operation of the small fingers 21. To facilitate the explanation, structural components other than the small fingers 21 are omitted, and identification numbers from 21-1 to -9 are assigned to the small fingers 21.

As shown in FIG. 4(*a*), where the punch P traverses to the right, the opening end portion CE of the can material C initially abuts against the small finger 21-4. The conventional finger section is configured by a single finger and cannot move in the axial direction. Therefore, a zone of the can material C that comes into contact with the finger receives a concentrated load from finger section. As a result, where the stress created by the load exceeds the compressive strength of the can material C, buckling occurs in this zone, causing wrinkles and, in the worst case, curls. However, the finger section 2 in accordance with the present invention is divided into three (a plurality of) small fingers 21 and each small finger 21 is configured so that it can move elastically in the axial direction. Therefor, the load received by the opening end portion CE is dispersed between multiple zones and reduced, as described hereinbelow, and load concentration can he advantageously avoided.

As shown in FIG. 4(*b*), where the punch P further moves to the right, the punch is pressed against the opening end portion CE and the small finger 21-4 also moves to the right. As a result, the small finger 21-3 also abuts against the opening end portion CE, presses against the opening end portion CE, and moves to the right. Then, the small finger 21-5 and small finger 21-7 also abut against the opening end portion CE.

As shown in FIG. 4(*c*), where the punch P still further moves to the right, the small finger 21-1, small finger 21-2, small finger 21-6, small finger 21-8, and small finger 21-9 also come into contact with the opening end portion CE. Because each small finger 21 is thus advantageously engaged according to the shape of the opening end portion CE, the load received by the can material C from the small fingers can be advantageously dispersed and reduced or absorbed. Where the punch P further moves, the can material C is stripped from the punch P and the can material C is taken off. As a result, when the can material C is pulled out off the punch P, buckling such as wrinkles and rupture such as curls are avoided.

With the stripper device 10 for a can drawing and ironing apparatus, the finger section 2 that grasps the punch P over which the can material C has been stretched is composed of a plurality of small fingers 21 and each small finger 21 is configured so that it can be moved elastically in the axial direction of the punch P. Therefore, the small fingers 21 can be engaged according to the concave-convex shape of the opening end portion CE of the can material C. When the can material C is pulled off from the punch P, the load received by the can material C from the small fingers 21 can be advantageously dispersed and reduced. As a result, the can material C stretched over the punch can be stably pulled off without causing buckling such as wrinkles and ruptures such as curls.

Further, because each finger section 2 is driven by the cam ring 4 via individual separate rocking arm 3 having the rocking fulcrum 31, the rocking arm 3 is biased in advance by the arm spring 32 in the direction of opening the small fingers 21, and the small fingers 21 are biased in advance by the finger spring 22 in a closing direction via the finger plate 23, when the head portion 33 of the rocking arm 3 mates with the concave portion of the cam portion 42 of the cam ring 4, the rocking arm 3 rotates about the rocking fulcrum 31 and raises the small fingers 21 under the effect of the arm spring 32, and the finger section 2 is opened. When the head portion 33 of the rocking arm 3 mates with a flat portion for the cam portion 42 of the cam ring 4, the rocking 3 rotates in the opposite direction under the effect of the cam portion 42 and sets the small fingers 21 into the initial state and the finger section 2 is closed under the effect OF the finger spring 22. As a result, the opening-closing operation of the finger section 2 can be performed rapidly and reliably, which in combination with good matching of the small fingers 21 with the opening end portion CE of the can material C ensures that the can material C that has been stretched over the punch P after drawing and ironing can be pulled out rapidly and with good stability.

Figure 5:
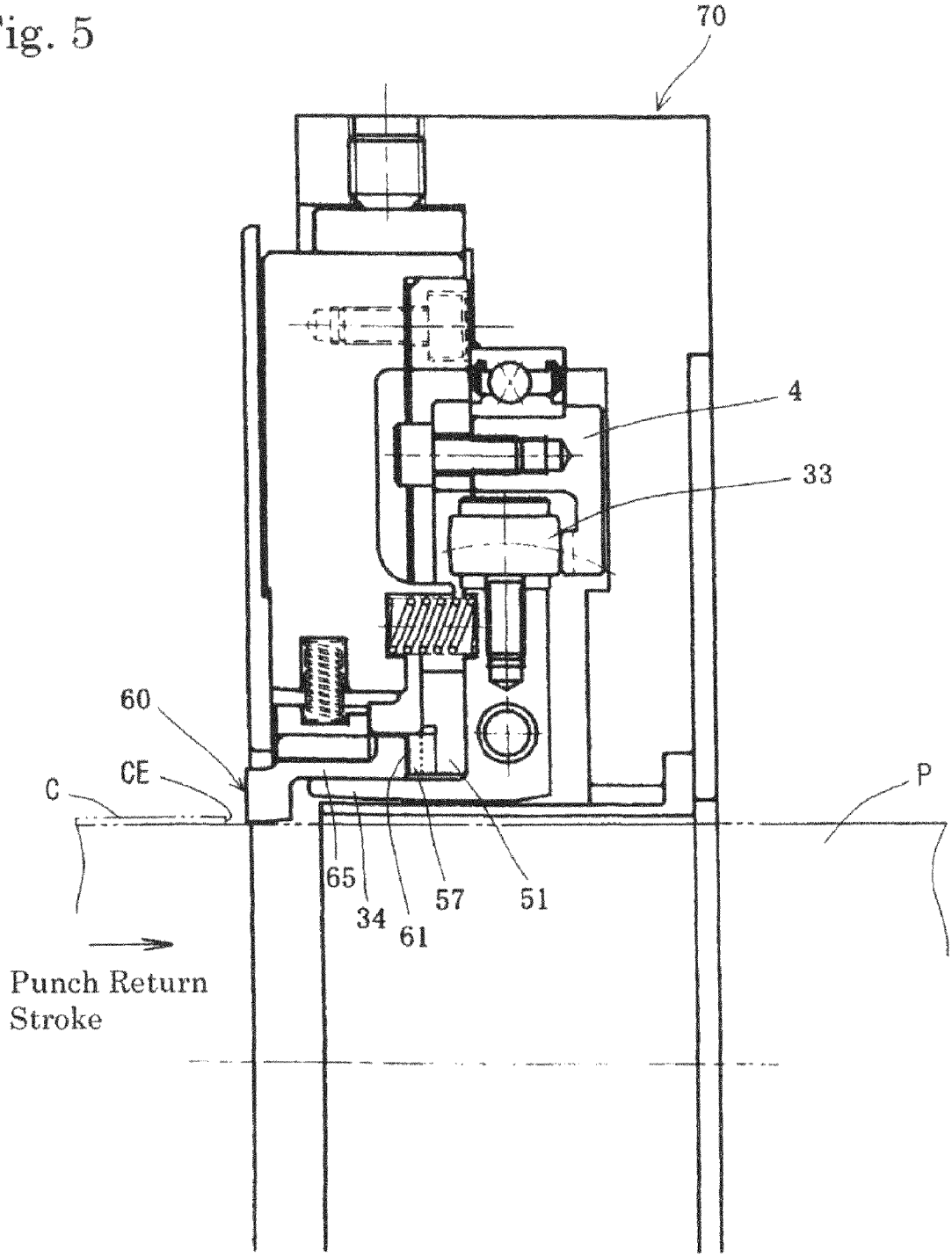
FIG. 5 is a principal cross-sectional view of a stripper device for a can drawing and ironing apparatus in accordance with another embodiment of the present invention in a state in which the finger sections are closed.
Figure 6:
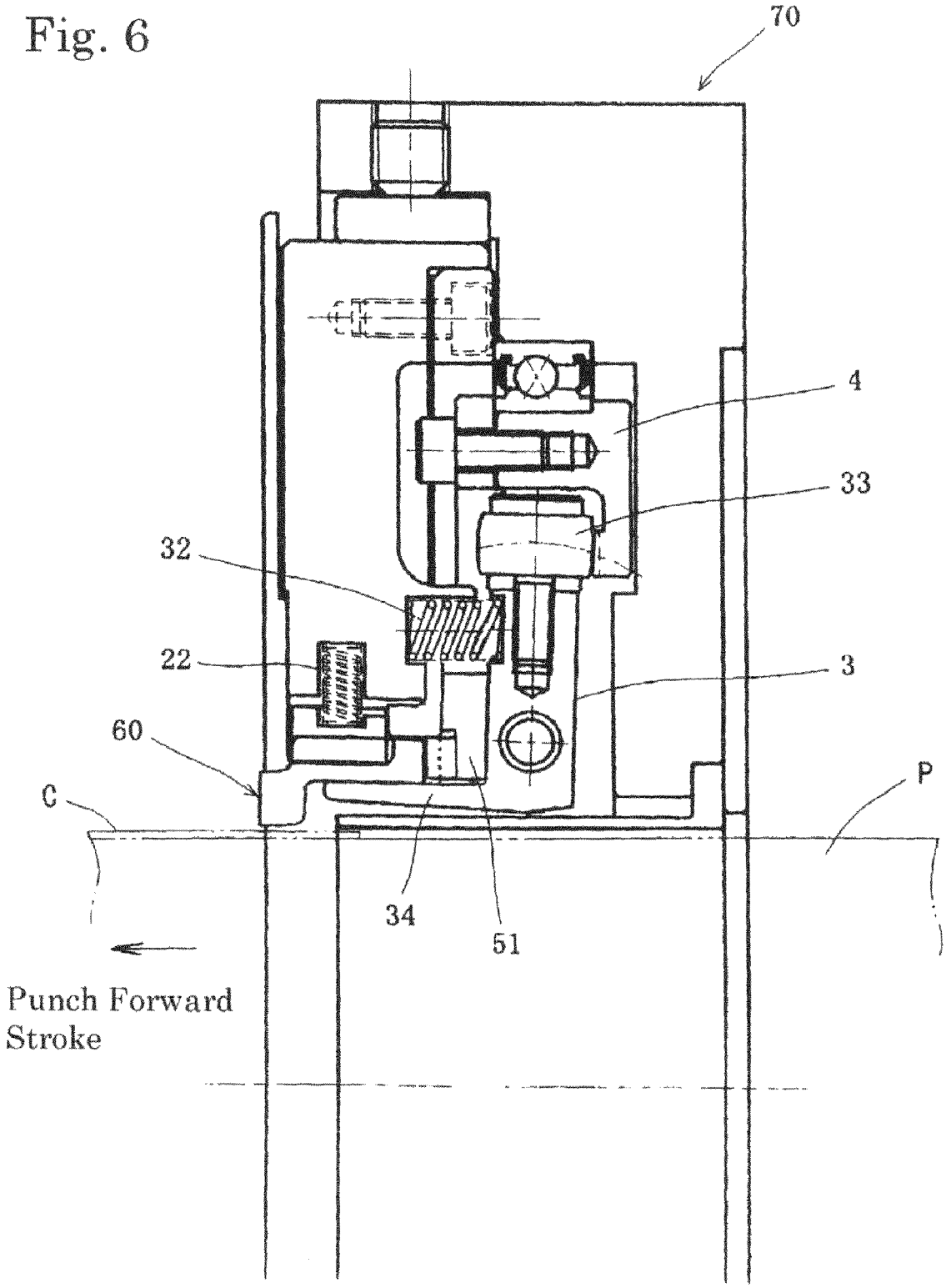
FIG. 6 is a principal cross-sectional view the finger sections are opened.

FIGS. 5 to 9 show a stripper device for a can drawing and ironing apparatus of another embodiment of the present invention. Members identical to those of the above-described embodiment are assigned with same reference numerals, detailed explanation thereof is omitted, and only the differences between the embodiments will be explained. FIGS. 5 and 6 are principal cross-sectional views illustrating the opening-closing state of fingers in the stripper device of the present embodiment. These figures correspond to FIGS. 2 and 3 of the above-described embodiment. The principal features of the device that differ from those of the above-described embodiment will be explained below in greater detail with reference to FIGS. 7 to 9.

FIG. 7 is a perspective view of an assembled unit 50 of finger sections in the present embodiment. Similarly to the above-described embodiment, six units are disposed on the circle.

In the stripper device of the embodiment illustrated by FIGS. 1 to 3, the elastic member 24 in the form of a rubber O-ring is used as the third elastic member. Distal end portions of the small fingers 21 abut against the elastic member and the small fingers can move elastically in the axial direction, but in addition to the axial movement, the small fingers sometimes slightly swing with respect to the axial direction due to the difference in abutment positions of the opening end portion CE of the can material, thereby creating a compressive force or shear force, or a combination force thereof that acts upon the elastic member 24, readily causing wear of the elastic member, and making it necessary to replace the elastic member after about 100,000 cans. Accordingly, in the present embodiment, the configuration of the above-described embodiment and features thereof are changed mainly with respect to the structure of the third elastic member so as to resolve the above-described problem, increase the wear resistance of the third elastic member, and ensure long-term production.

Figure 9:
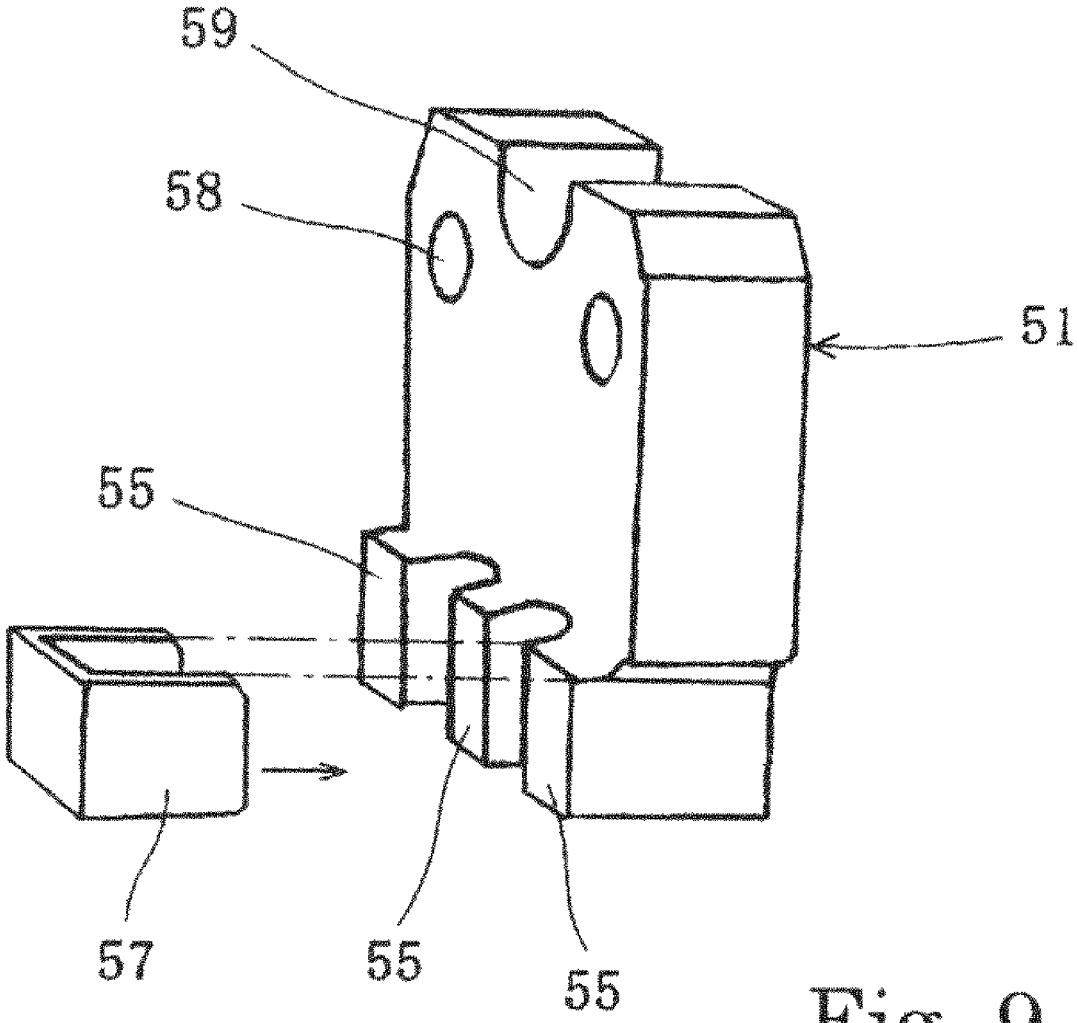
FIG. 9 is a perspective view of an elastic body and protective plate.

Thus, in the present embodiment, instead of the third elastic member in the form of an O-ring, as in the above-described embodiment, each finger section is independently provided with an elastic body 51 in the form of a rectangular parallelepiped that is made of a rubber and has a predetermined thickness, such as shown in FIG. 9, and the elastic body 51 is fixedly attached by a pair of bolts 54 to a side wall surface 35 of the rocking arm 3, with an attachment plate 53 being interposed therebetween. In the present embodiment, as shown in FIG. 9, three abutment protrusions 55 are formed at the lower portion of the elastic body 51 so that the abutment protrusions face the end portions 61 of the three small fingers 60 to be described later. A protective plate 57 made from a metal plate and having a U-like cross section that covers the abutment surface against which at least the distal end portion of the small finger 60 will abut is fitted onto the portion of the abutment protrusion 55 that serves as a receiving surface for the end portion 61 of the small finger 60. Therefore, because the distal end portion of the small finger abuts against the elastic body 51, with the protective plate 57, the compressive force or shear force created by the small finger will be received by the protective plate, only a unidirectional compressive force acts upon the elastic body 51, and wear or damage created by rubbing or the like can be prevented. The size of the protective plate 57 is controlled and, as shown in FIG. 7, the movement of the small finger is restricted to a distance equal to or less than a predetermined distance L (preferably about 2.0 mm). In this case, no excessively large compressive force is applied to the elastic body 51, endurance of the elastic body 51 is increased, and long-term operation of the device is made possible.

In FIG. 9, the reference numeral 58 stands for a bolt hole and 59 stands for a concave portion for inserting the arm spring 32 serving as the first elastic member provided between the spring holder and the surface of the rocking arm 3.

Further, in the present embodiment, a guide 62 for guiding the small fingers in the axial direction is provided to minimize unnecessary movement, such as torsion, of the small fingers with respect to the axial direction. The guide 62 is formed from a metal member in the form of a rectangular parallelepiped for each finger section, and a plurality of spline-like guiding grooves 63 are formed in the lower surface of the guide. Meanwhile, guiding protrusions 64 that mate with the guiding groove 63 of the guide 62 are formed at the upper source of small fingers 60, and the small fingers 60 can move parallel to the axial center along the guiding grooves 63. In the present embodiment, the finger plate 23 is placed on the upper surface of the guide 62 and small fingers are biased in the closing direction by the finger spring 22 as the second elastic member via the finger plate 23 and guide 62, but it is not necessary that the finger plate and guide be provided as separate members. Thus, the guiding grooves 63 may be formed in the lower surface of the finger plate and the finger plate and guide may be formed integrally.

FIGS. 5 and 6 are cross-sectional views of a stripper device 70 incorporating the unit 50 of the above-described configuration. FIG. 5 shows a state in which a stripper section is closed. FIG, 6 shows a state in which it is opened. In the unit 50, similarly to the above-described embodiment, an arm portion 65 of the small finger 60 is placed on the pickup portion 34 of the. rocking arm 3, and the end portion 61 of the arm portion abuts against the protective plate 57 that mates with the elastic body 51. The operation of small fingers performed to pull out the can material C that has been stretched over the punch from the punch is almost the same as in the above-describedembodiment. Therefore, redundant explanation thereof is omitted, and only specific operations of the present embodiment that differ from those of the above-described embodiment will be explained.

In a state shown in FIG. 5, that is, in a state in which the head portion 33 of the rocking arm abuts against the flat cam surface of the cam ring 4 and the small fingers are closed, where the molding is completed and the punch moves back and forth, the distal ends of the small fingers abut against the distal end CE of the can material C, the movement of the can material is stopped by the small fingers, and only the punch P moves, and the can material is separated from the punch P. In this case, the small fingers 60 receive an axial load corresponding to a mating friction force between the punch and can material and the guiding protrusions 64 of the small fingers 60 mate with the guiding grooves 63 of the guide 62. Therefore, the small fingers move parallel to the punch, without rocking, the end portions 61 of the small fingers abut against the protective plate 57 and press against the elastic body 51, thereby causing a predetermined amount of cushioning (1, shown in FIG. 7; about 2.0 mm). The position of the elastic body 51 against which the small fingers abut, is protected with the metallic protective plate 57, the end portions of small fingers do not come into the direct contact with the elastic body, and the compressive load is received only via the protective plate. Therefore, even in repeated abutment of the small fingers, the elastic body cannot be easily damaged and withstand lone-term operation and the production efficiency can be increased. In the forward stroke of the punch, the concave portions of the cam ring 4 rotate to positions corresponding to heads 33 of the rocking arms, whereby the pick-ups 34 of the rocking arms 3 raise and open the small fingers and the can material can be freely passed through without contact with the hooks of the small fingers, as shown in FIG. 6.

Industrial Applicability

The stripper device for a can drawing and ironing apparatus in accordance with the present invention can be advantageously applied to a process of pulling out a can material from a punch after the can material has been drawn and ironed, while being pushed into a gap between a die and the punch, as in the molding of DI cans or stretch drawn and ironed cans. The stripper device can be used especially advantageously in drawing and ironing of a can material laminated with a resin film on inner and outer surfaces.

The invention claimed is:

1. A stripper device for a can drawing and ironing apparatus, comprising: a plurality of finger sections that abut against an opening end portion of a can material that is stretched over a punch and detach the can material from the punch; and a drive unit that opens or closes each finger section, wherein the finger section is composed of a plurality of small fingers and each small finger is configured to be capable of elastically moving in an axial direction of the punch, wherein the drive unit is formed of a plurality of rocking arms each having a rocking fulcrum corresponding to each finger section and a rotatable cam ring that has cam portions that engage with the rocking arms, and wherein the rocking arms are biased in advance by a first elastic member in a direction of opening the small fingers, and the small fingers are biased in advance by a second elastic member in a closing direction.

2. The stripper device for a can drawing and ironing apparatus according to claim 1, wherein an upper portion of the rocking arms is engaged with the cam ring that can rotate relative to the axial direction of the punch, and the upper portion is configured to open the small fingers when mating with a concave portion of the cam ring.

3. The stripper device for a can drawing and ironing apparatus according to claim 1, wherein the plurality of small fingers constituting each finger section are biased in the closing direction by the second elastic member via a pushing member, and an end portion of each of the small fingers in the axial direction is locked to the lower portion of the rocking arm, with a third elastic member.

4. The stripper device for a can drawing and ironing apparatus according to claim 3, wherein the third elastic member is formed of an elastic body in the form of a rectangular parallelepiped mainly that is provided independently for each finger section, the third elastic member being attached to the rocking arm.

5. The stripper device for a can drawing and ironing apparatus according to claim 4, wherein a small finger abutment protrusion is formed at the elastic body in the form of the rectangular parallelepiped mainly, the small finger abutment protrusion being formed correspondingly to each end portion of the small fingers.

6. The stripper device for a can drawing and ironing apparatus according to claim 5, wherein a metal plate that covers the surface, against which at least the small finger abuts, is provided at a distal end portion of the small finger abutment protrusion.

7. The stripper device for a can drawing and ironing apparatus according to claim 3, wherein an axial guide is provided between an upper surface of each small finger and a lower surface of the pushing member so that each of the small fingers can move independently along the axial direction.

* * * * *